US011730291B2

(12) United States Patent
Maxfield et al.

(10) Patent No.: US 11,730,291 B2
(45) Date of Patent: Aug. 22, 2023

(54) RECONFIGURABLE PILLOW ENCLOSURE

(71) Applicant: Argon Technologies, Inc., Kaysville, UT (US)

(72) Inventors: Matthew Maxfield, North Salt Lake, UT (US); Cory Tholl, Kaysville, UT (US); Tyler Westbroek, Clearfield, UT (US); Shawn Parry, Salt Lake City, UT (US); Luke Metzger, Layton, UT (US)

(73) Assignee: ARGON TECHNOLOGIES, INC., Kaysville, UT (US)

( * ) Notice: Subject to any disclaimer, the term of this patent is extended or adjusted under 35 U.S.C. 154(b) by 132 days.

(21) Appl. No.: 16/953,650

(22) Filed: Nov. 20, 2020

(65) Prior Publication Data

US 2021/0153670 A1 May 27, 2021

Related U.S. Application Data

(60) Provisional application No. 62/939,371, filed on Nov. 22, 2019.

(51) Int. Cl.
*A47G 9/10* (2006.01)
*A47G 9/02* (2006.01)

(52) U.S. Cl.
CPC ..... *A47G 9/10* (2013.01); *A47G 9/1045* (2013.01); *A47G 9/0253* (2013.01)

(58) Field of Classification Search
CPC ..... A47G 9/10; A47G 2009/1018; A47G 9/1045; A47G 9/0253; A47G 9/1027;
(Continued)

(56) References Cited

U.S. PATENT DOCUMENTS 7,322,057 B2 * 1/2008 Merlini ..... A47G 9/1045 5/639
2005/0177941 A1 * 8/2005 Miller ..... A47G 9/0253 5/490

(Continued)

OTHER PUBLICATIONS

Attached. Merriam-Webster.com Dictionary, Merriam-Webster, https://www.merriam-webster.com/dictionary/attached. Accessed Sep. 23, 2022 (Year: 2016).*

(Continued)

*Primary Examiner* — David R Hare
*Assistant Examiner* — Deborah Talitha Gedeon
(74) *Attorney, Agent, or Firm* — Dentons Durham Jones Pinegar; Sarah W. Matthews; James Larson

(57) ABSTRACT

A pillow configured as a durable cushion as well as a more comfortable cushion. The pillow may include a single chamber with two sides extending between two different materials. A cushion may be positioned within the chamber and may be of such dimensions to fit within only one side of the chamber. When the cushion is positioned the first side of the chamber the second side of the chamber may include a void and the material on the second side may be rolled up and folded into an envelope on the first side maintaining the cushion. Alternatively, a user can move the cushion to the second side and the voided material of the first side can be rolled up into the envelope on the second side. The first side may be a more durable material, such as nylon, and the second side may be a softer material, such as cotton-jersey.

6 Claims, 12 Drawing Sheets

(58) Field of Classification Search
CPC ..... A47G 9/086; A47C 21/00; A47C 7/383; A47C 20/02
See application file for complete search history.

(56) References Cited

U.S. PATENT DOCUMENTS

| | | | | |
|---|---|---|---|---|
| 2009/0271927 | A1* | 11/2009 | Rodriguez | A47G 9/0253 5/640 |
| 2019/0246819 | A1* | 8/2019 | Lemoine | A63H 33/006 |

OTHER PUBLICATIONS

Therm-a-Rest Compressible Camping and Backpacking Pillow. https://www.amazon.com/Therm-Rest-Compressible-Camping-Backpacking/dp/B09NFGYJX1. (Year: 2021).*

* cited by examiner

RECONFIGURABLE PILLOW ENCLOSURE

PRIORITY CLAIM

This application claims priority to U.S. provisional application 62/939,371, filed 22 Nov. 2019, the entire contents of which are hereby incorporated by reference.

TECHNICAL FIELD

This disclosure relates generally to a pillow enclosure which may be used for a plurality of uses including, travel, camping, hammocking, backpacking, RV use and home use, and, more specifically, a pillow enclosure with a particular enveloped design with two differing fabrics. The pillow enclosure may include a first water and dust resistant fabric while the second fabric may be a soft cotton jersey-like fabric. The pillow inside the enclosure may be transferable or manipulated from one fabric to the other by sliding of the pillow from one fabric to another and then hiding the other fabric through use of the envelope design.

RELATED ART

Pillows and pillowcases have been utilized for centuries to provide comfort for an individual's head or body. Pillowcases have been utilized, as well as means for easily cleaning, so that the pillow would not require washing with each use. Different materials and fabrics have also been utilized for these pillowcases as well as the pillows themselves.

Camping pillows have also been found in the outdoor industry for some time. Lightweight cushions and fabrics have been considered as the covers to those pillows. Inflatable pillows, foam pillows, memory foam pillows, and others have all been considered. Camping provides a unique challenge because most individuals do not want to rest their head on a dirty pillow, so extra care must be taken to keep the pillow clean while camping. Pillow covers, or pillowcases, are often used and then simply washed once camping is over; however, while camping, those pillowcases and covers are known to get dirty because most pillowcases and covers are of a cotton or similar fabric that easily absorbs dirt and moisture.

Additional pillow covers or cases may consider a two-sided cover with two different materials on each side. One side of the fabric may be a polymer-like material to prevent water and dirt/dust absorption, while the other side may be a soft cotton like fabric. Simply turning the pillowcase inside out may be effective; however, the fabric of the pillow itself my absorb the dirt/dust and moisture that is now on the inside of the cover contacting the pillow itself, defeating one purpose of keeping it separate and clean.

A pillow that forms an integrated system for a cushion/pillow and comfort while providing cleanliness as well as a soft "cozy" feel is described further herein.

SUMMARY

The following disclosure relates to a pillow enclosure system including a first portion comprising: a first top panel and a first base panel secured together along a first longitudinal edge and a second opposing longitudinal edge. The first portion additionally comprises a first envelope secured along an interior lateral edge and secured along at least a portion of the first longitudinal edge and second opposing longitudinal edge. The pillow enclosure system also include a second portion comprising a second top panel and a second base panel secured together along the first longitudinal edge and the second opposing longitudinal edge. The second portion additionally comprises a second envelope secured along an opposing interior lateral edge and secured along at least a portion of the first longitudinal edge and second opposing longitudinal edge. In some embodiments, the first top panel and the second top panel are connected along a top side interior lateral edge. The first base panel and the second base panel may be connected along a base side interior lateral edge, connecting the first portion and second portion, and forming a continuous tubular-shaped enclosure.

According to another element, the pillow enclosure system may comprise a cushioning element, with the pillow enclosure system having a first configuration where the first portion maintains the cushioning element and the second portion is positioned within the first envelope. The pillow enclosure system may have a second configuration where the first envelope is unfolded, exposing the second portion with the second envelope and the second portion is unrolled, and the cushioning element is free to move between the first portion and second portion without the need to remove the cushioning element from the continuous tubular-shaped enclosure. The pillow enclosure system may have a third configuration where the second portion maintains the cushioning element, and the first portion is rolled up and positioned within the second envelope.

According to another aspect, the first portion and second portion comprise different materials. The first portion may comprise a first exterior lateral edge, and the second portion may comprise an opposing second exterior lateral edge. In some embodiments, the opposing second exterior lateral edge is closed and the first exterior lateral edge is selectively closeable.

According to another aspect, a method of transforming a pillow is described, the method including securing a first material, comprising a first chamber, to a second material, comprising a second chamber, along a periphery. The method can also include securing a first envelope along a top panel of the first material and securing a second envelope along a base panel of the second material. The method can additionally include positioning a cushioning material within the first chamber, rolling up the second material, and positioning the second material within the first envelope. The method can further include folding the first envelope over at least a portion of the top panel covering the second material.

The method may also include unfolding the first envelope, unrolling the second material, transferring the cushioning material from the first chamber to the second chamber, and rolling up the first material. Further, the method may include positioning the first material within the second envelope; and folding the second envelope over at least a portion of the base panel covering the first material.

According to another aspect, a pillow enclosure system may include a first portion comprising a tubular-shaped enclosure with a first exterior lateral edge and a first interior lateral edge. In some embodiments, the first portion further comprises a first connection means for securing a second portion, the first connection means secured along at least one of: the first interior lateral edge, a first longitudinal edge, and a second opposing longitudinal edge. The second portion may comprise a tubular-shaped enclosure with a second exterior lateral edge opposite the first exterior lateral edge of the first portion, and a second interior lateral edge connected to the first interior lateral edge of the first portion, the first portion and the second portion forming a continuous tubular-shaped enclosure in an open configuration.

In some configurations, the first exterior lateral edge is selectively closeable and the second exterior lateral edge is closed. For example, a zipper may close the first exterior lateral edge. The first connection means may comprise at least one of: straps, buckles, buttons, and VELCRO. A cushioning element may be moved from the first portion to the second portion without removing the cushioning element from the continuous tubular-shaped enclosure in the open configuration. For example, the pillow enclosure system may store the cushioning element within the first portion and the second portion may be attached to the pillow enclosure system via the first connection means. Similarly, the pillow enclosure system may store the cushioning element within the second portion with the first portion attached to the pillow enclosure system via the first connection means.

The first portion and second portion may comprise different materials. For example, the first portion may comprise a water-resistant fabric and second portion may comprise cotton.

According to one aspect, the first connection means comprises a first envelope of the first portion, the first envelope secured along the first interior lateral edge, the second portion positionable within the first envelope. In other configurations, the pillow enclosure system further comprises a second connection means, the second connection means comprising a second envelope of the second portion, the second envelope secured along the second interior lateral edge, the first portion positionable within the second envelope. The pillow enclosure system may comprise a cushioning material, the cushioning material transferrable from the first portion to the second portion without removing the cushioning material from the continuous tubular-shaped enclosure.

It will be appreciated that different methods of enclosing the separate portions of fabric may not only include an open-flap envelope as described herein but may also use hook and loop closures, buttons, snaps, zipper, magnets or similar fasteners.

DETAILED DESCRIPTION

Figure 1:
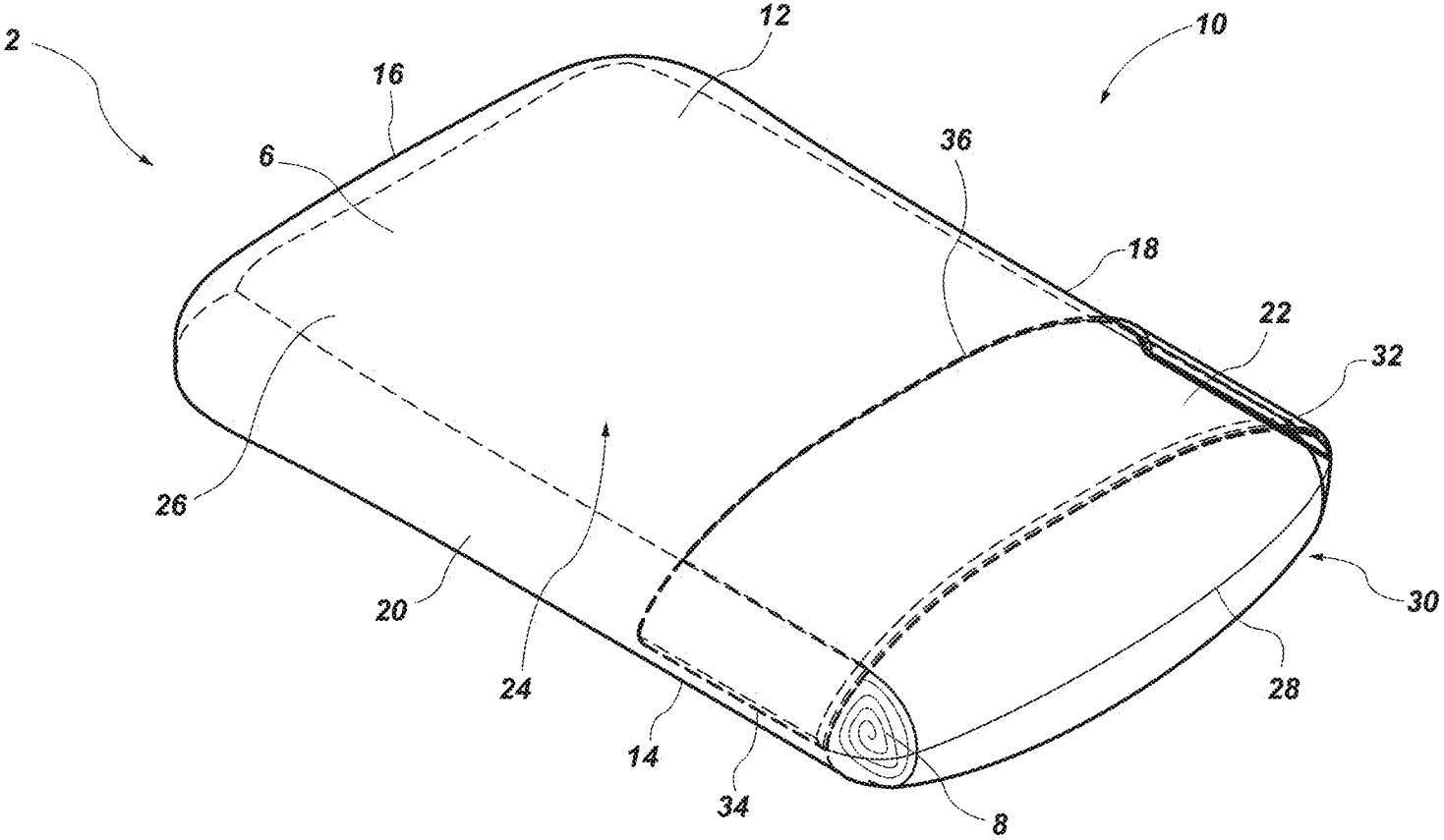
FIG. 1 is a perspective view of a pillow in a first configuration.
Figure 2:
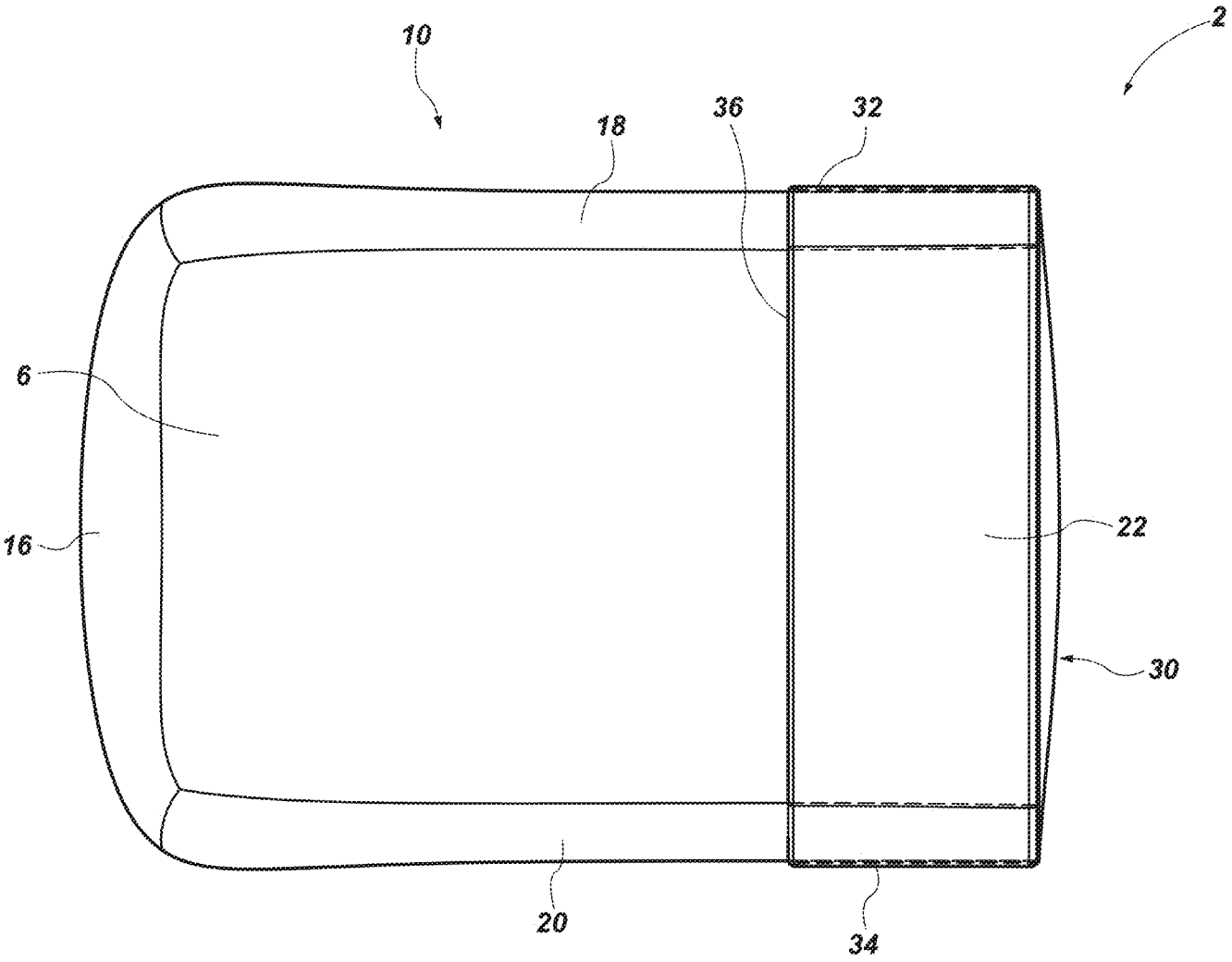
FIG. 2 is a top view of the pillow of FIG. 1 in the first configuration
Figure 3:
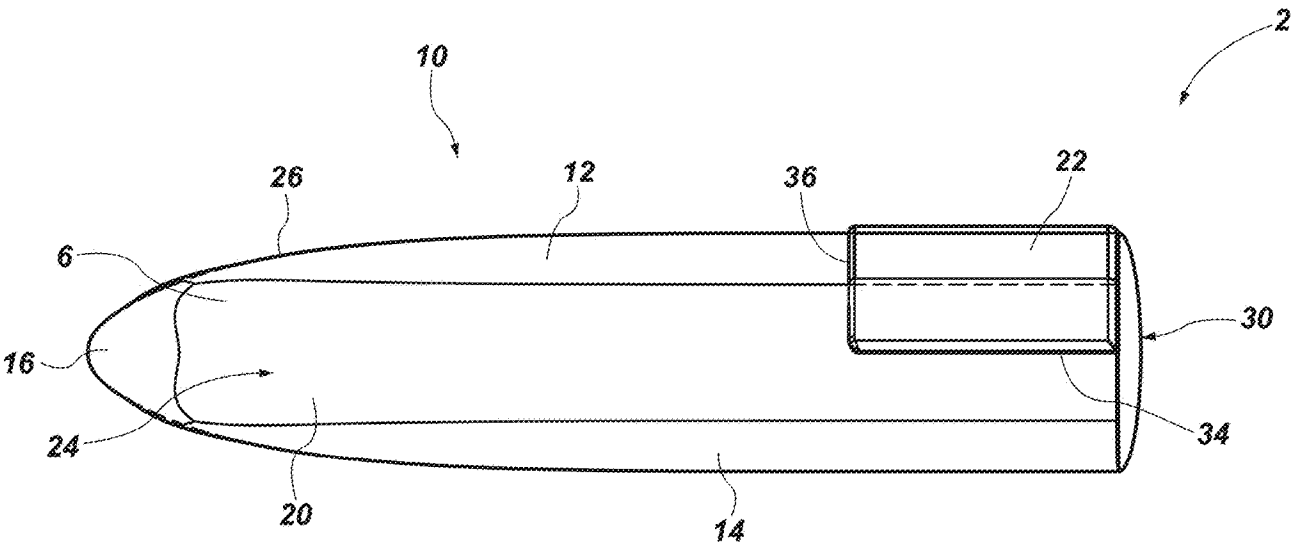
FIG. 3 is a longitudinal side view of the pillow of FIG. 1 in the first configuration.
Figure 4:
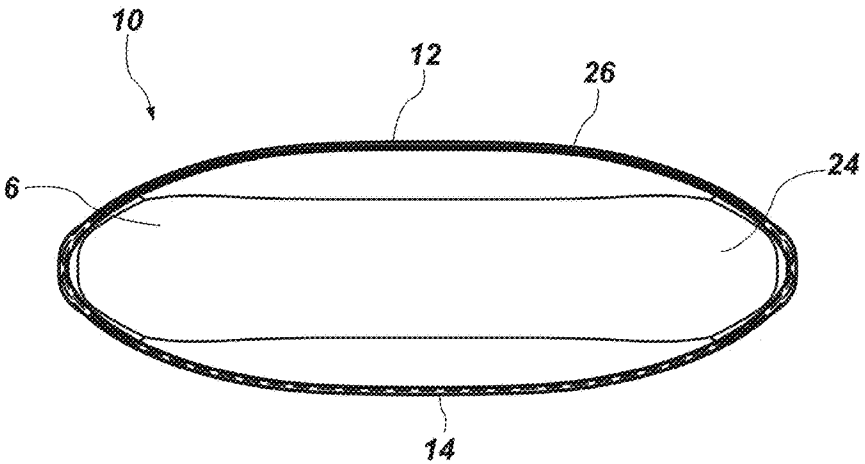
FIG. 4 is a first width side view of the pillow of FIG. 1; is a top view of the pillow of FIG. 1 in the second configuration.
Figure 5:
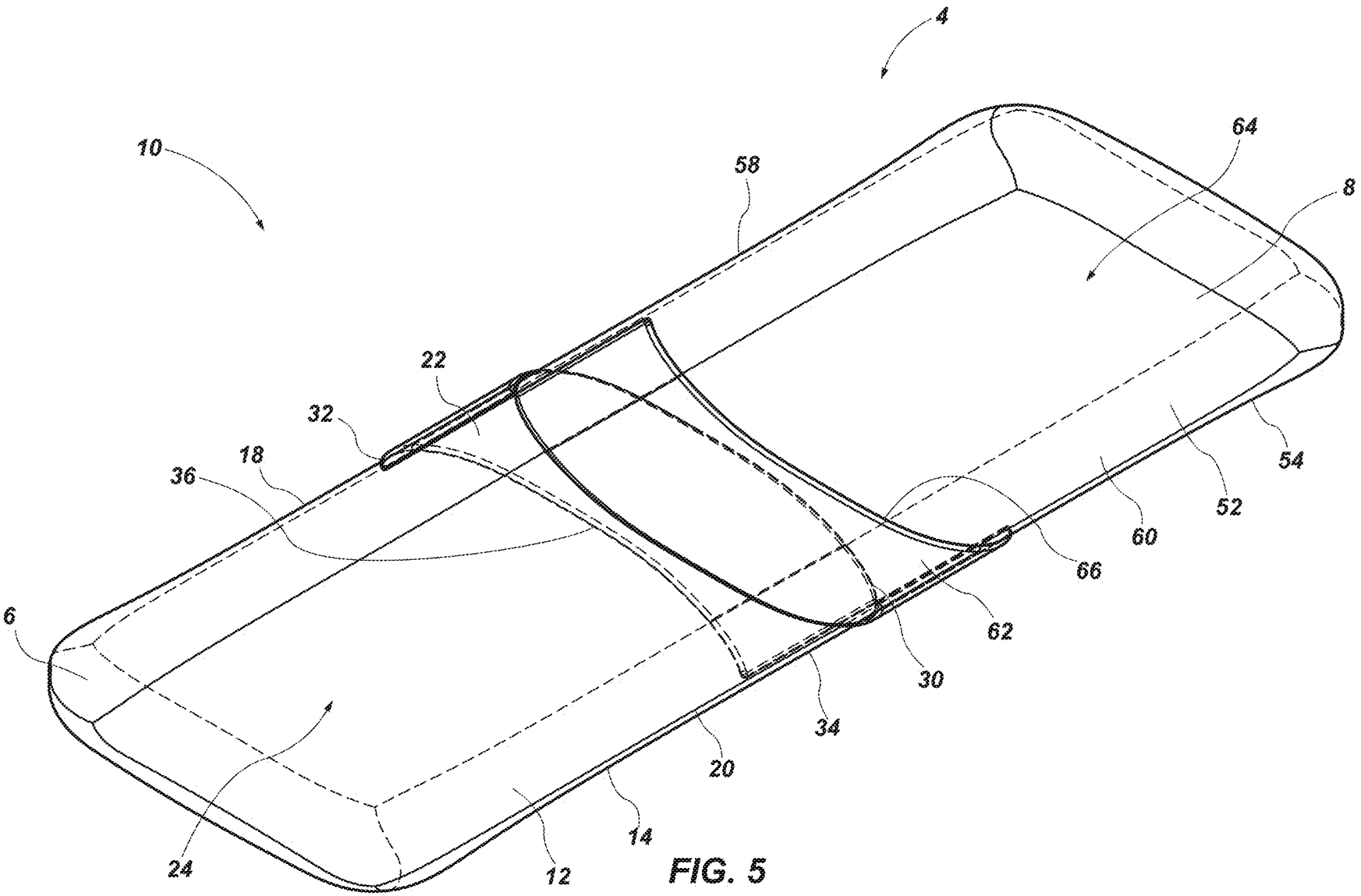
FIG. 5 is a perspective view of the pillow of FIG. 1 in a second configuration.
Figure 6:
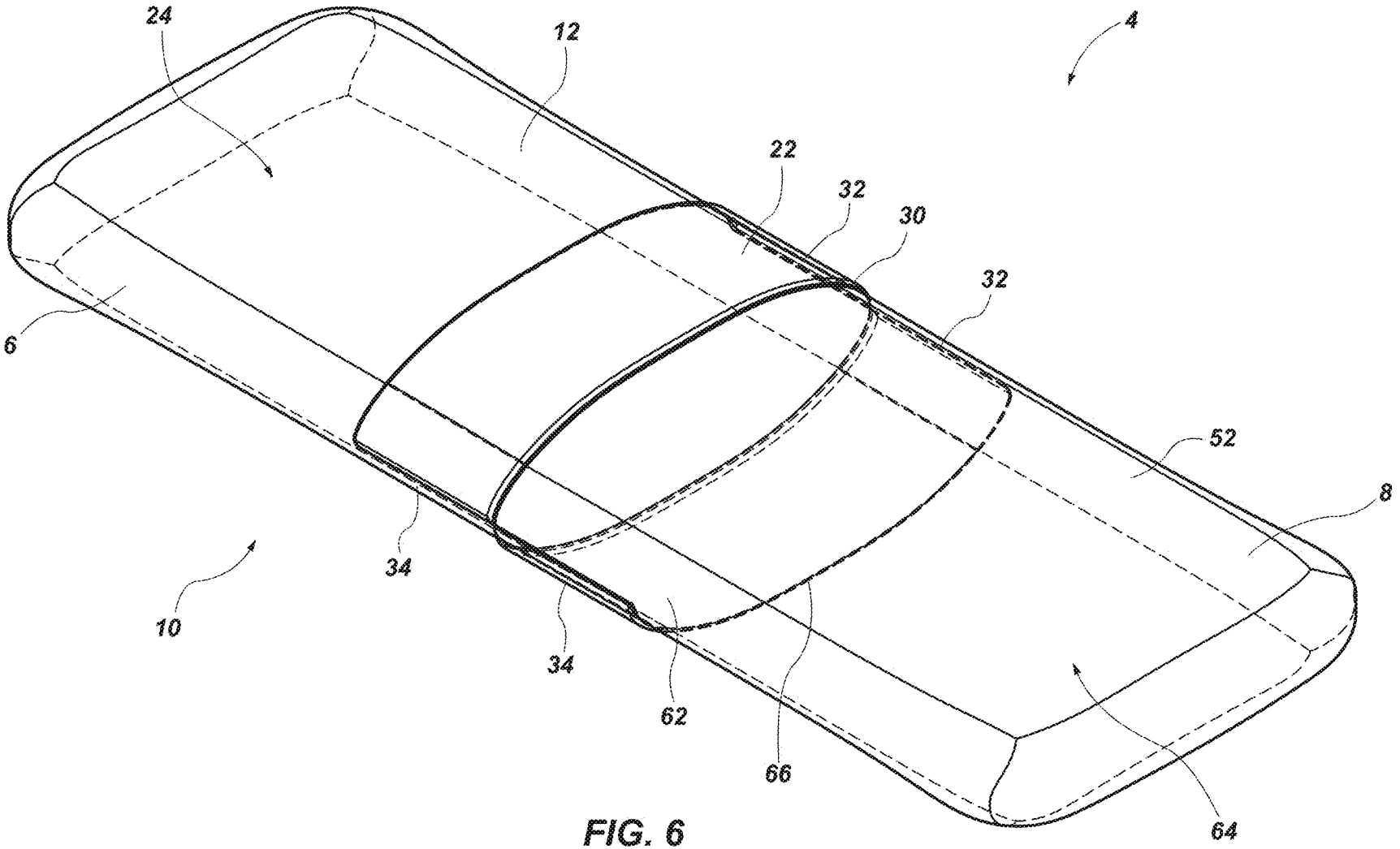
FIG. 6 is an alternate perspective view of the pillow of FIG. 1 in the second configuration.

The following description sets forth an embodiment of a pillow and its ability to be used in different configurations without utilizing additional materials than what is included in the pillow itself. The pillow may provide for durable material in a first configuration as well as soft and comfortable cushioning for a different feel and experience in a second configuration.

FIGS. 1 thru 4 illustrate a pillowcase 10, having a pillow or a cushion therein, in a first configuration 2. The pillowcase 10 generally includes a first portion 6 and a second portion 8. In FIGS. 1 thru 4, with the pillowcase 10 in the first configuration 2, only the first portion 6 of the pillowcase 10 is visible. As described in more detail below, the second portion 8 of the pillowcase 10 is folded or tucked into an envelope of the first portion 6 in the first configuration 2.

The first portion 6 of the pillowcase 10 may include a first top panel 12, a first base panel 14, a first end panel 16, a first right panel 18, and a first left panel 20. The first portion 6 of the pillowcase 10 may also include a first envelope 22, or envelope panel, biased toward one longitudinal end of the pillowcase 10 when in the first configuration 2. Alternatively, the first portion 6 of pillowcase 10 may only comprise a first top panel 12 and a first base panel 14 that intersect or are engaged to one another on a side and end of the pillowcase 10 by stitching, knitting, sewing, fusion or the like. For example, peripheral edges of the top panel 12 may be secured to peripheral edges of the base panel 14. In yet other configurations, the first portion 6 of pillowcase 10 may only comprise a first panel having a tubular shape.

The first portion 6 of pillowcase 10 may include a first chamber 24 within the first portion 6, and an outer surface 26 wherein the first chamber 24 may be completely closed off from the outer surface 26. The first chamber 24 may include a filling of foam, memory foam, gel, synthetic fiber, air, other cushioning element, or any combination of these within the first chamber 24 to provide cushioning and support to a user. In some configurations, the pillowcase 10 may be provided with an inner pillow or other filling; in other configurations the pillow and the case 10 may be sold together as a unit; and in yet other configurations the pillowcase 10 may be sold as a stand-alone item for a user to insert any pillow desired.

The first envelope 22 may be secured to either one of the first top panel 12 or the first base panel 14, and may extend from a peripheral edge 28 of a first end 30 and may be secured along the peripheral edge 28 as well as along at least a portion of a first longitudinal side 32 and a second longitudinal side 34. (Peripheral edge 28 may also be referred to as a "first interior lateral edge 28" when the pillowcase 10 is in the second, extended position, as described in more detail below. Similarly, first end 30 may be referred to as "first portion inner end 30" when the pillowcase 10 is in the second, extended position.) The first envelope 22 may extend along a portion of the longitudinal length of the first top panel 12 and/or first base panel 14, and may extend anywhere from 10% of the longitudinal length of the panels 12, 14 to 50% of the longitudinal length of the panels 12, 14. The first envelope 22 may include an opening 36, or open end, that is proximal the first end 30. The opening 36 is to allow the first envelope 22 to be folded, opened, or flipped, while secured on three sides. The first envelope 22 is able to hold material within the envelope 22 and particularly additional material as will be further described herein, such as a second portion 8 of the pillowcase 10.

Additional or different material or fabric may be held, positioned or rolled within the first envelope 22 toward the first end 30 when the pillowcase 10 is in the first configuration 2. The additional material may be utilized as further disclosed herein.

FIGS. 5 thru 8 illustrate the pillowcase 10 in a second, extended configuration 4. The pillowcase 10 may further include a second portion 8, comprising a second top panel 52, a second base panel 54, a second end panel 56, a second right panel 58 and a second left panel 60. The first top panel 12 and second top panel 52 may be substantially planar, as may the first base panel 14 and second base panel 54. As previously described, the first top panel 12 and first base panel 14 may be engaged around a peripheral edge; similarly the second top panel 52 and second base panel 54 may also be engaged or secured in a similar manner. In other words, the second top panel 52 and the second base panel 54 may be secured together along the first longitudinal side 32 and the second opposing longitudinal side 34.

The first top panel 12 of the first portion 6 and the second top panel 52 may be connected along an interior lateral edge 30 (which, in the first configuration 2, was a first end 30, but in the extended, second configuration 4, is now positioned in the center between the first portion 6 and the second portion 8 and is therefore referred to as an "interior lateral edge" in this position). More specifically, the first top panel 12 and the second top panel 52 may be connected along a top side interior lateral edge 30*a*. The first base panel 14 and the second base panel 54 may be connected along a bottom side interior lateral edge 30*b*. The connection between the top panels 12, 52 and the bottom panels 14, 54 of each of the first portion 6 and second portion 8 thus connect the first portion 6 and second portion 8 and form a continuous tubular-shaped enclosure.

In the second configuration 4, the pillowcase 10 may be extended, or expanded, to a length longer than in the first configuration 2 and perhaps twice as long as in the first configuration 2. The first chamber 24 may be expanded and may allow for the filling to move into a second chamber 64 of the second portion 8 creating one long chamber. A second envelope 62 may be exposed when the pillowcase 10 is in the second configuration 4 and may have the same or substantially the same positioning on the pillowcase 10 as well as the same dimensions and features of the first envelope 22, including a second opening 66, or open end, that is positioned proximal the first end 30. The second envelope 62 may also perform the same or substantially the same function as the first envelope 22, and may function to hold the first portion 6 of the pillowcase 10.

The first top panel 12, first base panel 14, and first envelope 22 may be the same first material which may be a polyurethane, like nylon or other like durable material which may be waterproof and/or dust proof. The second top panel 52, second base panel 54, and second envelope 62 may be the same second material that may be a cotton-jersey like or similar soft material. Alternatively, the first and second materials can be the same material. Other suitable materials may be used as desired and the use of such is contemplated herein.

Figure 7:
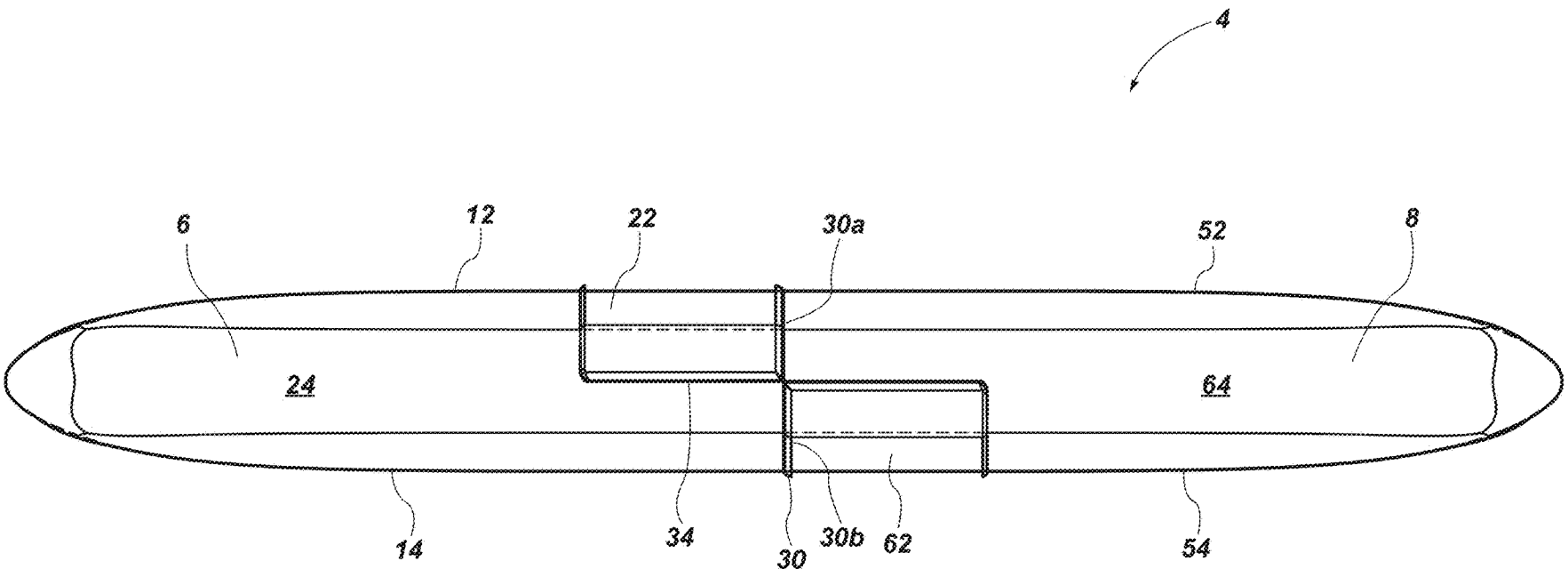
FIG. 7 is a longitudinal side view of the pillow of FIG. 1 in the second configuration.
Figure 8:
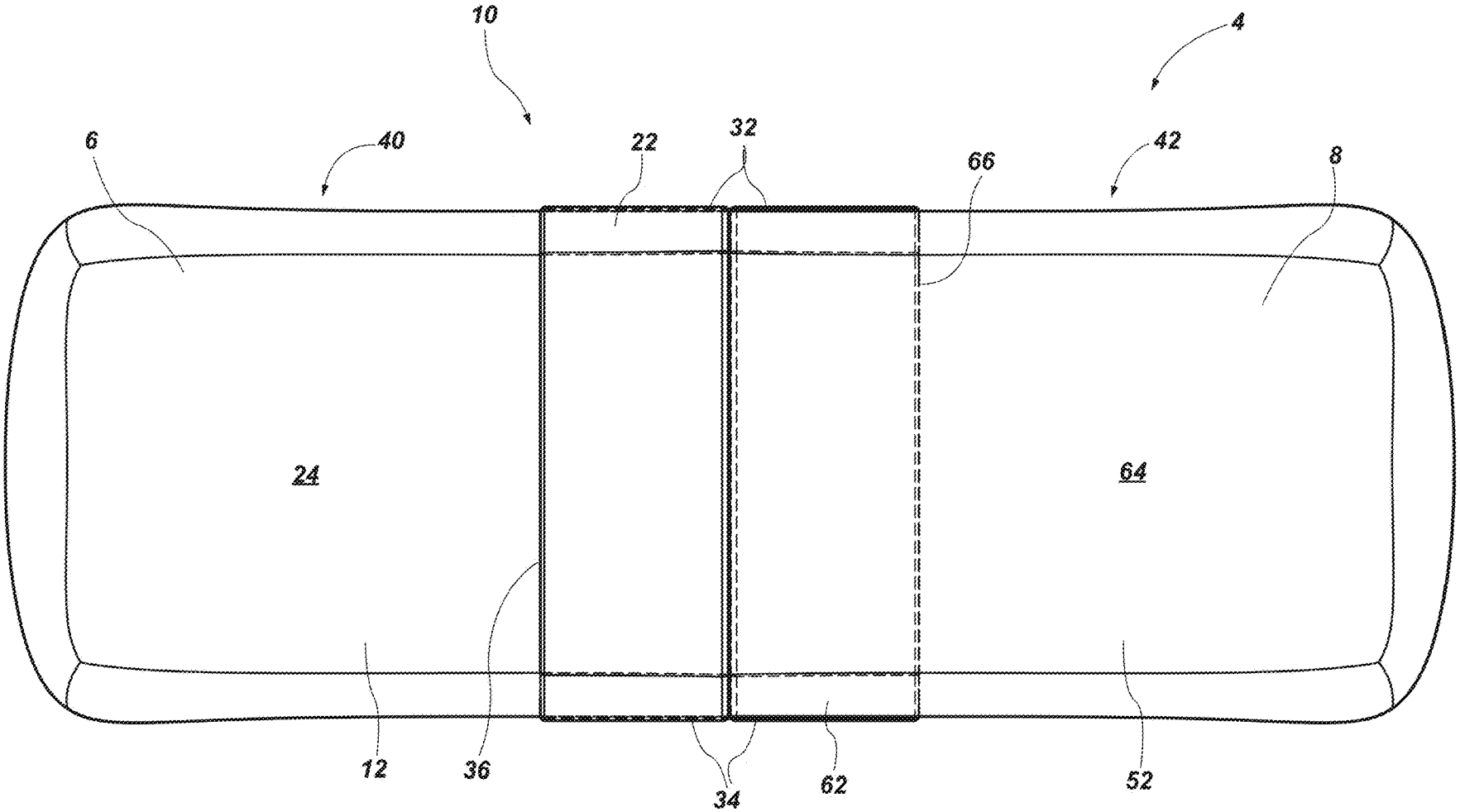
FIG. 8 is a top view of the pillow of FIG. 1 in the first configuration.

Referring specifically to FIG. 7, the envelopes 22 and 62 can be seen wherein the envelopes 22, 62 may extend from opposite sides of the first end 30 or interior lateral edge 30, which, in the second configuration 4, becomes a central portion or center of the pillowcase 10. The first envelope 22 may extend over a portion of the first top panel 12 while the second envelope 62 may extend over a portion of the second base panel 54. It will be appreciated that the envelopes 22 and 62 may be reversed wherein the first envelope 22 may extend over a portion of the first base panel 14 while the second envelope 62 may extend over a portion of the second top panel 52. Essentially the first envelope 22 and second envelope 62 may be diagonal or cater-cornered from each other in the second configuration 4.

In the second configuration 4, each of the first envelope 22 and second envelope 62 are in an open configuration, or unfolded configuration, and each is exposed along the longitudinal length of the pillowcase 10. The open or extended configuration 4 allows the filling, an insert, a pillow, etc. to transfer from the first chamber 24 of the first portion 6 to the second chamber 64 of the second portion 8, or vice versa.

Figure 9:
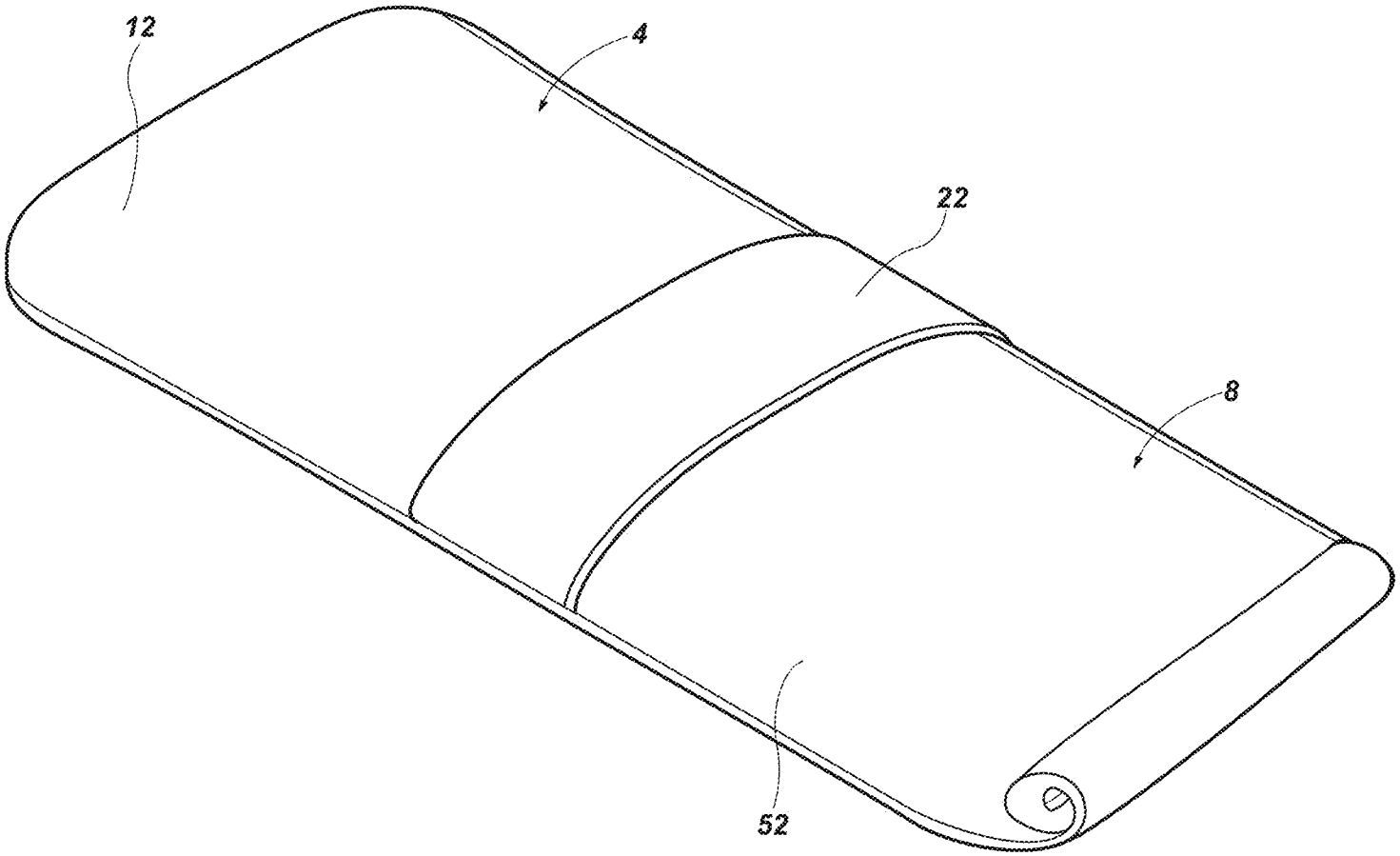
FIG. 9 is a perspective view of the pillow of FIG. 1 between the first configuration and second configuration.

With the filling in either one of the first chamber 24 or second chamber 64, the opposite portion of the pillowcase 10 of where the filling resides may be rolled, stuffed or secured within the envelope 22, 62 of the filled side. For example, regarding FIG. 9, a first portion 6 may hold the filling within the first chamber 24 and a second portion 8 may be rolled up and secured within the first envelope 22 when the first envelope 22 is moved to a closed configuration 2, holding the extra material of the second portion 8 within the envelope as depicted in FIG. 1.

The pillowcase 10 may also include a zipper or other accessible means to provide filling, an insert, or a pillow within the pillowcase 10. The zipper may be on one side or plurality of sides and may be accessible with the first material, second material or both.

The pillowcase 10 may be comprised of a two single pieces of fabric secured at each of their interior lateral edges 30, each cut in substantially rectangular formats and secured together along opposing longitudinal edges of the two single pieces of fabric, forming one long tubular shaped pillowcase. One or both exterior opposing lateral edges may be permanently or selectively closed. Alternatively, the pillowcase 10 may be comprised of a single piece of material cut in a substantially rectangular format. Further still, the pillowcase 10 may be comprised of multiple pieces of fabric and secured together along their peripheries to create a substantially rectangular format. Other shapes and sizes may also be used.

Materials that may be utilized for the pillowcase 10 have been briefly disclosed herein but may be comprised of any fabric or non-woven material. Nylon fabric may be utilized for its durability and for its lightweight qualities for one side of the pillowcase while the other side may be cotton-jersey, microfiber or the like to provide a softness as well. The respective first envelope 22 and second envelope 62 may be comprised of the same material to match its respective side of the pillowcase 10.

Another embodiment and configuration considered is a reversible fabric such that the additional fabric can simply reverse over itself to cover the pillow without having to move the internal cushioning element from one side to another.

Figure 10:
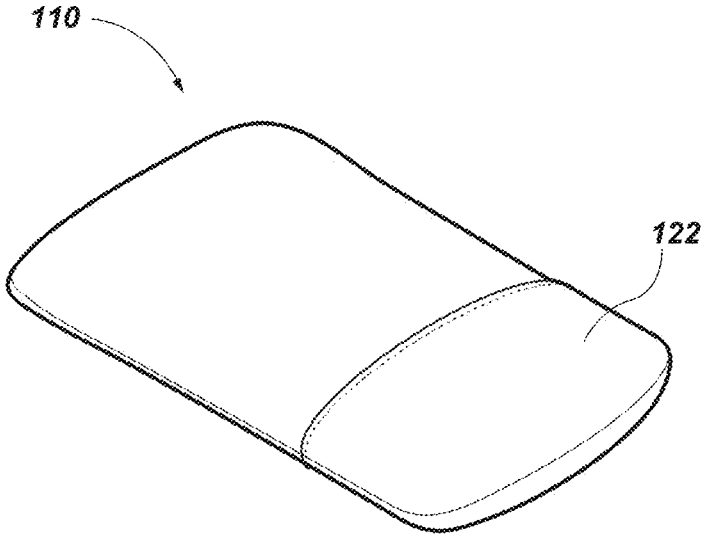
FIG. 10 is a perspective view of another pillow case as described herein in a first configuration.
Figure 11:
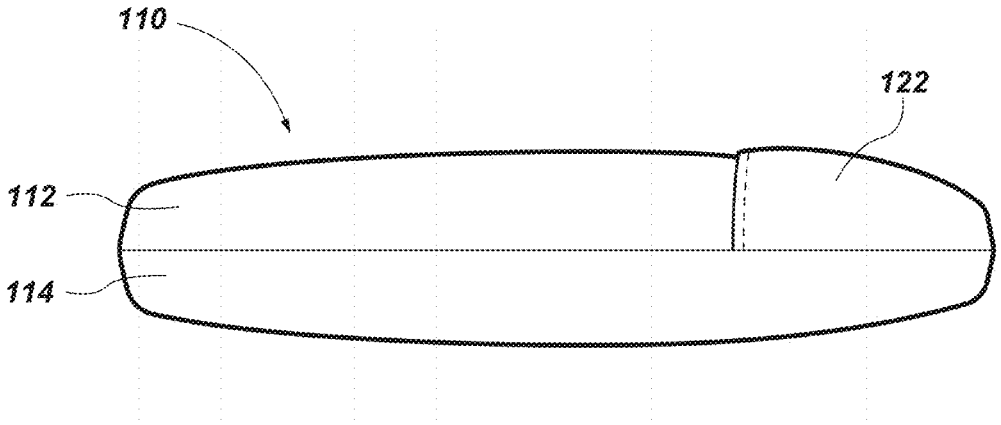
FIG. 11 is a side view of the pillow case of FIG. 10.

FIGS. 10-11 show an alternative configuration of the pillowcase 110 as described herein. For example, the pillowcase 110 may not include a separate left and right panel, but rather a first top panel 112 connected directly to a first base panel 114.

Figure 12:
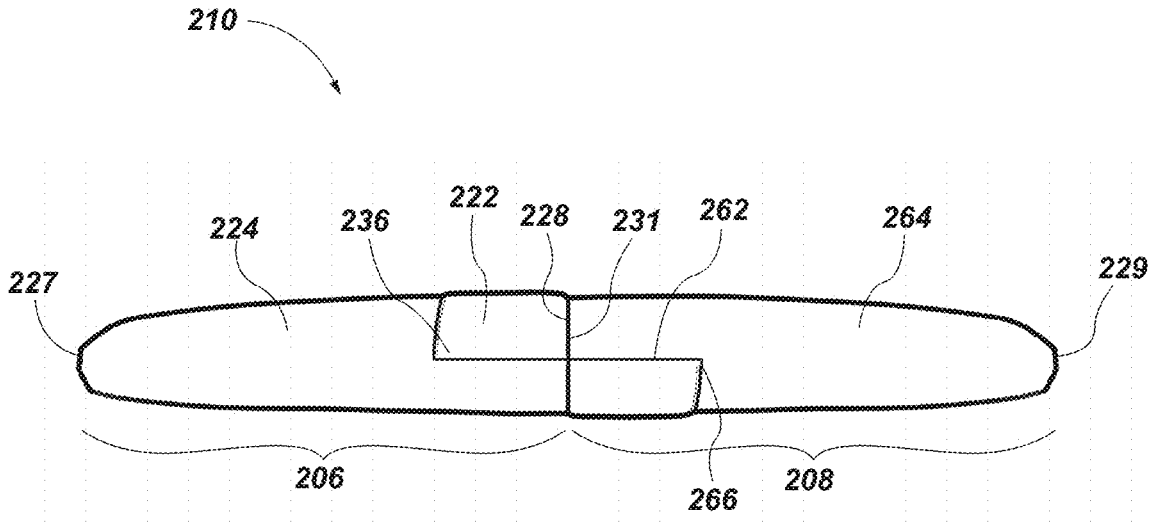
FIG. 12 is a side view of another pillowcase as described herein in a second configuration.
Figure 13:
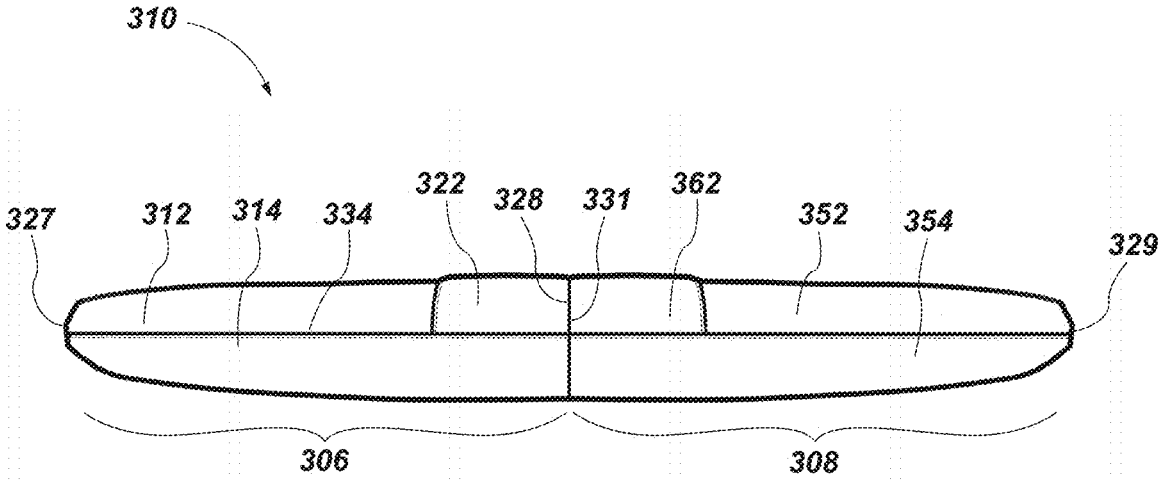
FIG. 13 is a side view of yet another configuration of a pillowcase in a second configuration.

FIGS. 12-13 show two alternate configurations of the pillowcase 210 as described herein. In FIG. 12, the pillowcase 210 is comprised of a first portion 206 and a second portion 208, and includes first envelope 222 and second envelope 262 cater-corned from each other. The first portion 206 is a tubular-shaped enclosure with a first exterior edge 227 and a first interior lateral edge 228. The second portion 208 is similarly a tubular-shaped enclosure with a second exterior lateral edge 229 opposite the first exterior lateral edge 227 of the first portion 206. The second portion 208 is connected along its second interior lateral edge 231 to the first interior lateral edge 228 of the first portion, forming a continuous tubular-shaped enclosure. In this configuration, the second exterior lateral edge 229 is permanently closed (such as by being sewn, stitched, knitted, fused, etc.), while the first exterior lateral edge 227 is provided with a zipper, to selectively access the interior of the pillowcase 210 and chambers 224 and 264. Other selectively closable means, such as buttons, snap-fasteners, etc., may be provided to selectively close the first exterior lateral edge 227.

FIG. 13 shows a pillowcase 310 where the first portion 306 and the second portion 308 are each formed from a top panel (312 of the first portion 306 and 352 of the second portion 308) and a base panel (314 of the first portion 306 and 354 of the second portion 308). FIG. 13 also illustrates a configuration in which each of the envelopes 322 and 362 are connected or sewn on the same side of the pillowcase 310, rather than being cater-corned as shown in other configurations.

FIGS. 14-17 illustrate yet another configuration contemplated herein. These configurations illustrate pillowcases without any envelopes for attaching the unused portion of the pillowcase. In some configurations, other means are provided for attaching an unused portion of the pillowcase, and in yet other configurations, no means are provided for attaching an unused portion of the pillowcase. Means for attaching an unused portion of the pillowcase may include any suitable means known in the art, such as buckles, straps, buttons, VELCRO, zippers, magnets, rings, and/or combinations thereof, etc. Other securing mechanisms may also be used and are contemplated herein.

Figure 14:
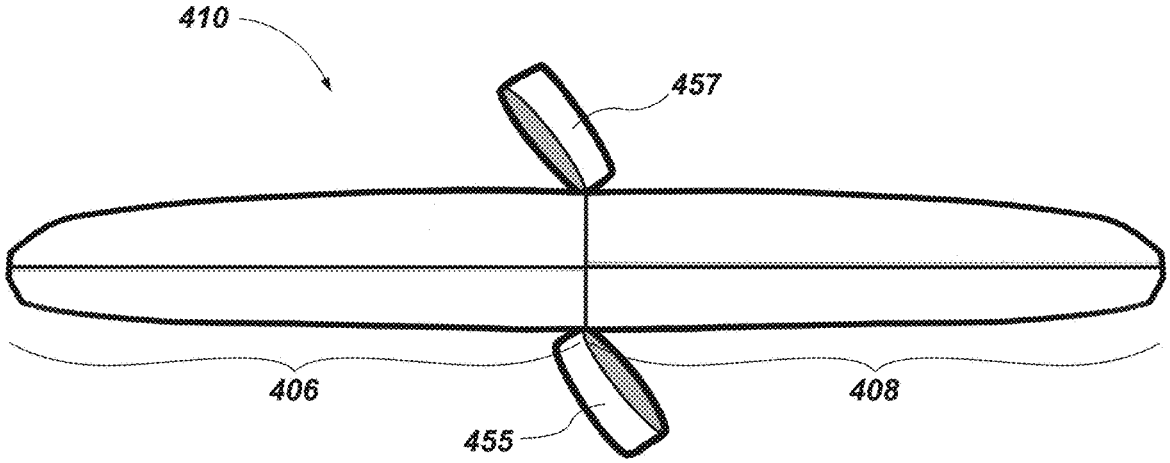
FIG. 14 is a side view of yet another configuration of a pillowcase in a second configuration.
Figure 15:
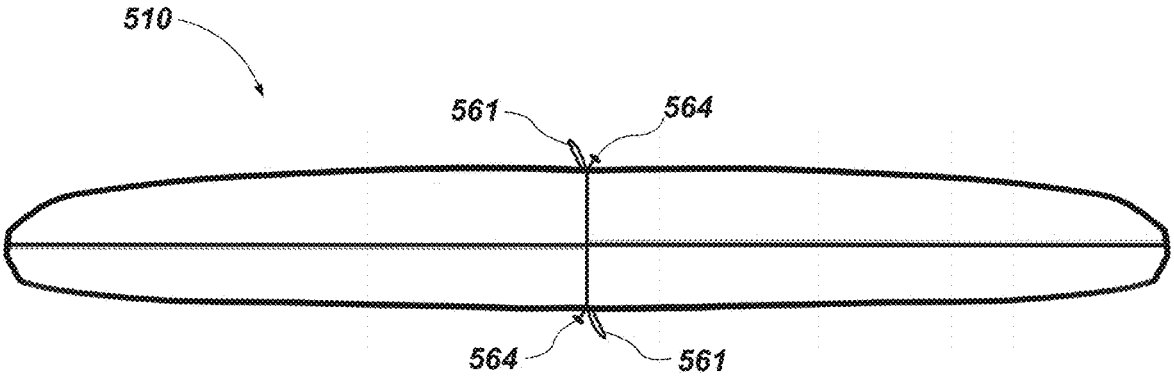
FIG. 15 is a side view of yet another configuration of a pillowcase in a second configuration.

In FIG. 14, no envelopes are provided on the pillowcase 410, but rather two caps, 455 and 457 are secured to the pillowcase 410. The unused portion of the pillowcase 410 may be stuffed into one of the caps 455, 457 provided. For example, when a user has the pillow stored in portion 406, the unused portion 408 may be stuffed, rolled, or otherwise placed in cap 455. Similarly, FIG. 15 shows a pillowcase 510 which is provided with one or more loops 561 and toggles 564. The loops 561 may be formed of any suitable material, and in some configurations the loops 561 may be formed of a material with some flexibility/stretchability, such as elastic or an elastic blend material. The unused portion of the pillowcase 510 may be rolled or folded and placed through the loop 561, with the toggle 564 used to secure the unused portion within the loop 561.

Figure 16:
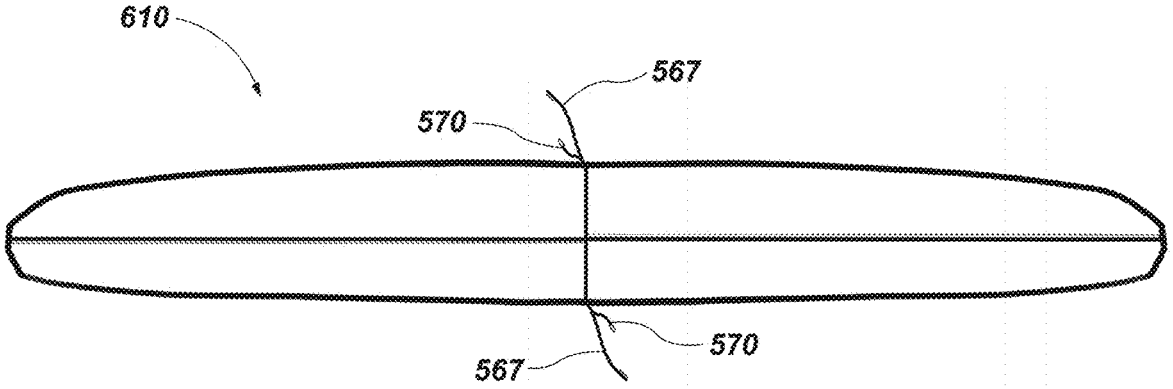
FIG. 16 is a side view of yet another configuration of a pillowcase in a second configuration.
Figure 17:
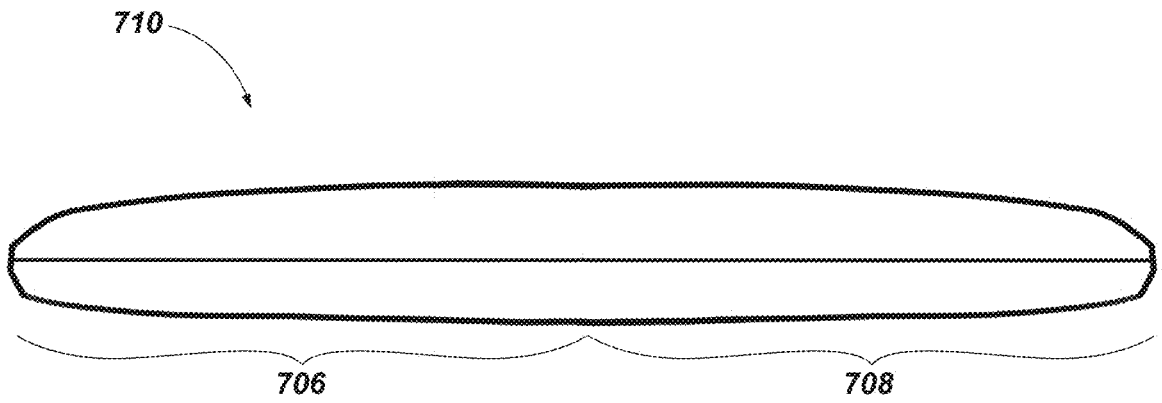
FIG. 17 is a side view of yet another configuration of a pillowcase in a second configuration.

FIG. 16 illustrates a pillowcase 610 which may be provided with one or more straps 567 and one or more buckles 570 for receiving the straps 567. The straps 567 may or may not include VELCRO to further secure the straps 567. The unused portion of the pillow may be rolled up, the strap 567 placed around the unused portion, and secured from the buckle 570. In yet other configurations, such as pillowcase 710 shown in FIG. 17, no securing mechanism is provided. A user may simply slide the pillow to the portion of the case that they would like to use, for example either a first portion 706 or a second portion 708, and roll or stuff the unused portion without securing it.

As one example of use, given by way of illustration and not limitation, a pillowcase may include a first side formed of water-resistant fabric, and a second side formed of a softer fabric. A user may first select which side of the pillowcase to use. For example, if the user is travelling, they may wish to use a side of the pillowcase that is made of a water- and/or dirt-resistant fabric. The user may slide a pillow inside the pillowcase to the first side made of the water- and/or dirt-resistant fabric. The user may then secure the opposite side (formed of softer material) within the envelope of the first side. When the user has reached their destination and wishes to sleep with the pillow, the user may unfold the softer side from the first envelope, and shake or otherwise move the pillow to the softer side of the pillowcase. With the pillow in the softer side, the user may then roll or stuff the first side formed of water-resistant material into the envelope of the second side. This may assist in keeping the pillow clean during travel, and comfortable during use for sleeping or relaxing.

Although the foregoing disclosure provides many specifics, these should not be construed as limiting the scope any of the ensuing claims. Other embodiments may be devised which do not depart from the scopes of the claims. Features from different embodiments may be employed separately or in combination. Accordingly, all additions, deletions and modifications to the disclosed subject matter that fall within the scopes of the claims are to be embraced thereby. The scope of each claim is indicated and limited only by its plain language and the full scope of available legal equivalents to its elements.

What is claimed:

1. A pillow enclosure system comprising:

a first portion and a second portion attached along an interior lateral edge;

the first portion comprising:

a first top panel and a first base panel secured together along a first longitudinal edge and a second opposing longitudinal edge;

a first envelope secured along a top side of the interior lateral edge and secured along at least a portion of the first longitudinal edge and second opposing longitudinal edge;

a second portion comprising:

a second top panel and a second base panel secured together along the first longitudinal edge and the second opposing longitudinal edge;

a second envelope secured along a base side of the interior lateral edge and secured along a portion of the first longitudinal edge and the second opposing longitudinal edge; and wherein the first top panel and the second top panel are connected along the top side interior lateral edge and wherein the first base panel and the second base panel are connected along the base side interior lateral edge, connecting the first portion and second portion and forming a continuous tubular-shaped enclosure.

2. The pillow enclosure system of claim 1, wherein the pillow enclosure system includes a cushioning element, the pillow enclosure system having a first configuration wherein the first portion maintains the cushioning element and the second portion is positioned within the first envelope.

3. The pillow enclosure system of claim 1, wherein the pillow enclosure system includes a cushioning element, the pillow enclosure system having a second configuration wherein the first envelope is unfolded exposing the second portion with the second envelope and the second portion is unrolled and the cushioning element is free to move between the first portion and second portion without removing the cushioning element from the continuous tubular-shaped enclosure.

4. The pillow enclosure system of claim 1, wherein the pillow enclosure system includes a cushioning element and wherein the pillow enclosure system comprises a third configuration wherein the second portion maintains the cushioning element and the first portion is rolled up and positioned within the second envelope.

5. The pillow enclosure system of claim 1 wherein the first portion and second portion comprise different materials.

6. The pillow enclosure system of claim 1, wherein the first portion comprises a first exterior lateral edge, and the second portion comprises an opposing second exterior lateral edge, and wherein the opposing second exterior lateral edge is closed and the first exterior lateral edge is selectively closeable.

* * * * *